US007694969B2

(12) United States Patent
Abrahamson

(10) Patent No.: US 7,694,969 B2
(45) Date of Patent: Apr. 13, 2010

(54) CASINO WAGERING GAME OF THREE-DICE FOOTBALL

(75) Inventor: Jamie Abrahamson, 1 Columbus Pl., Apt. #N29B, New York, NY (US) 10019

(73) Assignee: Jamie Abrahamson, New York, NY (US)

( * ) Notice: Subject to any disclaimer, the term of this patent is extended or adjusted under 35 U.S.C. 154(b) by 370 days.

(21) Appl. No.: 11/487,213

(22) Filed: Jul. 14, 2006

(65) Prior Publication Data

US 2008/0012219 A1 Jan. 17, 2008

(51) Int. Cl.
*A63F 3/00* (2006.01)

(52) U.S. Cl. ..... 273/247; 273/274

(58) Field of Classification Search ..... 273/247, 273/274, 244.1, 246

See application file for complete search history.

(56) References Cited

U.S. PATENT DOCUMENTS

| | | | | | |
|---|---|---|---|---|---|
| 4,334,685 | A | | 6/1982 | Robbins et al. | 273/274 |
| 4,635,938 | A | | 1/1987 | Gray | 273/274 |
| 4,706,959 | A | * | 11/1987 | Price | 273/247 |
| 4,743,025 | A | | 5/1988 | Gramera | 273/146 |
| 5,133,559 | A | | 7/1992 | Page | 273/274 |
| 5,413,351 | A | | 5/1995 | Franklin | 273/274 |
| 5,505,457 | A | | 4/1996 | Boylan et al. | 273/274 |
| 5,620,183 | A | | 4/1997 | Skratulia | 273/146 |
| 5,791,651 | A | | 8/1998 | Bryant | 273/274 |
| 5,806,847 | A | | 9/1998 | White et al. | 273/309 |
| 5,879,006 | A | | 3/1999 | Bowling | 273/274 |
| 6,209,874 | B1 | | 4/2001 | Jones | 273/274 |
| 6,378,869 | B1 | | 4/2002 | Hedge, Jr. et al. | 273/274 |
| 6,755,420 | B2 | * | 6/2004 | Colton | 273/274 |
| 6,893,019 | B2 | | 5/2005 | Gaygen | 273/274 |

* cited by examiner

*Primary Examiner*—Benjamin H Layno
(74) *Attorney, Agent, or Firm*—Mark A Litman & Associates, P.A.

(57) ABSTRACT

A wagering game simulates competitive events and terminology. The game is played by:

a player placing at least one wager to play in the wagering game;

casting three dice to generate a random event, the three dice consisting of two dice whose exposed numbers are used to define a numeric result, and the third die used to characterize that numeric result in event result tables or paytables;

comparing the random event of the casting of the three dice with the paytables to determine wagering or game events from the random event; and resolving wins or losses based upon the random event; moving a game piece in a continuing of the wagering game; or both resolving wins or losses based upon the random event and moving a game piece in a continuing of the wagering game.

14 Claims, 4 Drawing Sheets

EXHIBIT B- 3 DICE FOOTBALL
DICE MATRIX

| G G | R | RES | G G | R | RES | G G | R | RES | G G | R | RES | G G | R | RES | G G | R | RES |
|---|---|---|---|---|---|---|---|---|---|---|---|---|---|---|---|---|---|
| 1 1 | 1 | TD | 1 1 | 2 | TO | 1 1 | 3 | PEN | 1 1 | 4 | PEN | 1 1 | 5 | PEN | 1 1 | 6 | PEN |
| 1 2 | 1 | 2 | 1 2 | 2 | 1 | 1 2 | 3 | 0 | 1 2 | 4 | PEN | 1 2 | 5 | PEN | 1 2 | 6 | PEN |
| 1 3 | 1 | 3 | 1 3 | 2 | 2 | 1 3 | 3 | 1 | 1 3 | 4 | 0 | 1 3 | 5 | PEN | 1 3 | 6 | PEN |
| 1 4 | 1 | 4 | 1 4 | 2 | 3 | 1 4 | 3 | 2 | 1 4 | 4 | 1 | 1 4 | 5 | 0 | 1 4 | 6 | PEN |
| 1 5 | 1 | 5 | 1 5 | 2 | 4 | 1 5 | 3 | 3 | 1 5 | 4 | 2 | 1 5 | 5 | 1 | 1 5 | 6 | 0 |
| 1 6 | 1 | 6 | 1 6 | 2 | 5 | 1 6 | 3 | 4 | 1 6 | 4 | 3 | 1 6 | 5 | 2 | 1 6 | 6 | 1 |
| 2 1 | 1 | 2 | 2 1 | 2 | 1 | 2 1 | 3 | 0 | 2 1 | 4 | PEN | 2 1 | 5 | PEN | 2 1 | 6 | PEN |
| 2 2 | 1 | 3 | 2 2 | 2 | TD | 2 2 | 3 | 1 | 2 2 | 4 | TO | 2 2 | 5 | PEN | 2 2 | 6 | PEN |
| 2 3 | 1 | 4 | 2 3 | 2 | 3 | 2 3 | 3 | 2 | 2 3 | 4 | 1 | 2 3 | 5 | 0 | 2 3 | 6 | PEN |
| 2 4 | 1 | 5 | 2 4 | 2 | 4 | 2 4 | 3 | 3 | 2 4 | 4 | 2 | 2 4 | 5 | 1 | 2 4 | 6 | 0 |
| 2 5 | 1 | 6 | 2 5 | 2 | 5 | 2 5 | 3 | 4 | 2 5 | 4 | 3 | 2 5 | 5 | 2 | 2 5 | 6 | 1 |
| 2 6 | 1 | 7 | 2 6 | 2 | 6 | 2 6 | 3 | 5 | 2 6 | 4 | 4 | 2 6 | 5 | 3 | 2 6 | 6 | 2 |
| 3 1 | 1 | 3 | 3 1 | 2 | 2 | 3 1 | 3 | 1 | 3 1 | 4 | 0 | 3 1 | 5 | PEN | 3 1 | 6 | PEN |
| 3 2 | 1 | 4 | 3 2 | 2 | 3 | 3 2 | 3 | 2 | 3 2 | 4 | 1 | 3 2 | 5 | 0 | 3 2 | 6 | PEN |
| 3 3 | 1 | 5 | 3 3 | 2 | 4 | 3 3 | 3 | TD | 3 3 | 4 | 2 | 3 3 | 5 | 1 | 3 3 | 6 | TO |
| 3 4 | 1 | 6 | 3 4 | 2 | 5 | 3 4 | 3 | 4 | 3 4 | 4 | 3 | 3 4 | 5 | 2 | 3 4 | 6 | 1 |
| 3 5 | 1 | 7 | 3 5 | 2 | 6 | 3 5 | 3 | 5 | 3 5 | 4 | 4 | 3 5 | 5 | 3 | 3 5 | 6 | 2 |
| 3 6 | 1 | 8 | 3 6 | 2 | 7 | 3 6 | 3 | 6 | 3 6 | 4 | 5 | 3 6 | 5 | 4 | 3 6 | 6 | 3 |
| 4 1 | 1 | 4 | 4 1 | 2 | 3 | 4 1 | 3 | 2 | 4 1 | 4 | 1 | 4 1 | 5 | 0 | 4 1 | 6 | PEN |
| 4 2 | 1 | 5 | 4 2 | 2 | 4 | 4 2 | 3 | 3 | 4 2 | 4 | 2 | 4 2 | 5 | 1 | 4 2 | 6 | 0 |
| 4 3 | 1 | 6 | 4 3 | 2 | 5 | 4 3 | 3 | 4 | 4 3 | 4 | 3 | 4 3 | 5 | 2 | 4 3 | 6 | 1 |
| 4 4 | 1 | 7 | 4 4 | 2 | 6 | 4 4 | 3 | 5 | 4 4 | 4 | TD | 4 4 | 5 | 3 | 4 4 | 6 | 2 |
| 4 5 | 1 | 8 | 4 5 | 2 | 7 | 4 5 | 3 | 6 | 4 5 | 4 | 5 | 4 5 | 5 | 4 | 4 5 | 6 | 3 |
| 4 6 | 1 | 9 | 4 6 | 2 | 8 | 4 6 | 3 | 7 | 4 6 | 4 | 6 | 4 6 | 5 | 5 | 4 6 | 6 | 4 |
| 5 1 | 1 | 5 | 5 1 | 2 | 4 | 5 1 | 3 | 3 | 5 1 | 4 | 2 | 5 1 | 5 | 1 | 5 1 | 6 | 0 |
| 5 2 | 1 | 6 | 5 2 | 2 | 5 | 5 2 | 3 | 4 | 5 2 | 4 | 3 | 5 2 | 5 | 2 | 5 2 | 6 | 1 |
| 5 3 | 1 | 7 | 5 3 | 2 | 6 | 5 3 | 3 | 5 | 5 3 | 4 | 4 | 5 3 | 5 | 3 | 5 3 | 6 | 2 |
| 5 4 | 1 | 8 | 5 4 | 2 | 7 | 5 4 | 3 | 6 | 5 4 | 4 | 5 | 5 4 | 5 | 4 | 5 4 | 6 | 3 |
| 5 5 | 1 | 9 | 5 5 | 2 | 8 | 5 5 | 3 | 7 | 5 5 | 4 | 6 | 5 5 | 5 | TD | 5 5 | 6 | 4 |
| 5 6 | 1 | 10 | 5 6 | 2 | 9 | 5 6 | 3 | 8 | 5 6 | 4 | 7 | 5 6 | 5 | 6 | 5 6 | 6 | 5 |
| 6 1 | 1 | 6 | 6 1 | 2 | 5 | 6 1 | 3 | 4 | 6 1 | 4 | 3 | 6 1 | 5 | 2 | 6 1 | 6 | 1 |
| 6 2 | 1 | 7 | 6 2 | 2 | 6 | 6 2 | 3 | 5 | 6 2 | 4 | 4 | 6 2 | 5 | 3 | 6 2 | 6 | 2 |
| 6 3 | 1 | 8 | 6 3 | 2 | 7 | 6 3 | 3 | 6 | 6 3 | 4 | 5 | 6 3 | 5 | 4 | 6 3 | 6 | 3 |
| 6 4 | 1 | 9 | 6 4 | 2 | 8 | 6 4 | 3 | 7 | 6 4 | 4 | 6 | 6 4 | 5 | 5 | 6 4 | 6 | 4 |
| 6 5 | 1 | 10 | 6 5 | 2 | 9 | 6 5 | 3 | 8 | 6 5 | 4 | 7 | 6 5 | 5 | 6 | 6 5 | 6 | 5 |
| 6 6 | 1 | 11 | 6 6 | 2 | 10 | 6 6 | 3 | 9 | 6 6 | 4 | 8 | 6 6 | 5 | 7 | 6 6 | 6 | TD |

Legend:
G: Green Die
R: Red Die
RES: Result
TD: Instant Touchdown
TO: Turnover
PEN: Penalty

FIG. 3

CASINO WAGERING GAME OF THREE-DICE FOOTBALL

BACKGROUND OF THE INVENTION

1. Field of the Invention

The present invention relates to the field of wagering games, particularly casino table wagering games and most particular casino table wagering games using dice as the generators of random events.

2. Background of the Art

Dice games have been used for gambling and entertainment for centuries. Dice games are well known in the art. Craps is probably the best-known dice gambling game. Craps is representative of multiple roll dice games in which some types of bets are not resolved for two, three or more rolls of the dice. Some types of bets in Craps known as proposition wagers are resolved on one roll. The biggest problem with Craps, from the point of view of the player, is that the rules appear to be complex. Thus, it takes considerable study and/or playing time to learn to play with a level of comfort. These limitations are also the major problem with Craps from the point of view of the game operator (e.g., the casino). The apparent complexity of Craps intimidates some potential players who choose not to play or to play at minimum wagers and therefore lower the revenue of the casino.

Single roll dice games, such as those shown in U.S. Pat. No. 5,806,847 (White, et al.) are inherently simpler than multiple roll games such as Craps. However, the single roll dice games have fewer betting choices available to the players. Players tend to lose interest more easily in a game that has relatively few betting choices.

Some dice games increase the number of possible bets by using more than one or even more than two dice, such as the use of three dice of the same color (e.g., U.S. Pat. No. 5,879,006, Bowling). The game disclosed by Bowling also involves multiple rolls for some types of bets and complex rules to be learned by the player.

Another three dice game is disclosed in U.S. Pat. No. 6,209,874 (Jones). This game uses three dice, each a different color. The bets are resolved in one roll, which is simpler to learn than a multiple roll game. However, the use of three different color dice and bets involving the relative relationships of the outcome of the individual dice still results in a complex game that is likely to inhibit some potential players.

U.S. Pat. No. 4,334,685 (Robbins) describes a three dice wagering game using a playing surface that includes seven rows which are so demarcated by a line directed from the top to the bottom of the surface as to render each row into two sections. The area now at the left is identified by indicia explaining in detail the co-related area's purpose immediately to its right which is the betting area. Five such betting areas on the right side are further divided into a plurality of betting stalls, each stall having two components. One component, at the upper part thereof has indicia showing the betting 'number' and the other component at the lower part thereof has indicia showing the odds offered thereon. The remaining two betting areas on the right side are not divided but are emblazoned with indicia showing the type of bet therein and flanked on each side of the emblazonment with the odds offered therein. The combinations and permutations probability of the simultaneous ONE THROW OF THREE DICE (two WHITE dies and one RED die) which immediately completes each game has an indirect bearing on the odds shown in the plurality of betting areas. Various colors of betting chips are adapted to be selectively placed on the various betting units. However, each player must have a different identifying colored stack of chips from each of the other players and must be 'paid-off' in the same like-colored chip the bet was made with, which of course, coincides with the color of the stack of chips presently in front of the player.

U.S. Pat. No. 4,635,938 (Gray) describes a dice game using three dice of tetrahedron type. Two of the dice are colored white and the third die has four colors on separate surfaces, each colored surface having a differing numerical value as well. The play is commenced by first rolling the two white dice to obtain a numerical value of one of ten possibilities upon which first bets have been placed. The second roll utilizes the third colored die to determine the remainder of the wagering which include: odd/even, hard three, six, nine, and twelve; the total numerical value of the three dice, the listed numbers shown on each die, and the color and number of the third die.

U.S. Pat. No. 4,743,025 (Gramera) teaches a three dice game in which each of the two hundred sixteen possible numerical combinations of three six-sided dice is visually differentiated, one from the other, by retaining the six differently numbered faces on a conventional first neutral die; coding each of the six differently numbered faces on a second die with separate figure symbols; and coding each of the six numbered faces on a third die with separate colors and five different numbers. One of the faces of the third die repeats the number on one of the other faces of that die. Rolling the set of three dice over an extended period of time will display each of the expected fifteen numerical sums, ranging in values from three through seventeen, in two-hundred-sixteen separate and visually differentiated combinations, each turning up with equal odds of 1 in 216. Development of this coding technique, to separate and expand the normally expected fifteen numerical sums to two-hundred-sixteen numerical scores, by visually differentiating each of two-hundred-sixteen possible combinations of three six-sided dice, rolled with equal odds, affords a simplified but practical application to create a variety of new dice related games incorporating game boards, playing cards or a combination thereof.

U.S. Pat. No. 5,133,559 (Page) describes a gaming system in which a set of six dice provides two groups of intransitive dice, each group containing three dice (10, 20 and 30). The dice of one group are sized larger than those of the other group. Each die is one of three colors and each group of three intransitive dice includes a die of each color. The six dice are used in a casino game wherein all dice are rolled and then twelve possible bets are resolved. These bets fall into three catagories: contests between two dice of the same size but different colors, contests between two dice of one color and two dice of another color, and contests matching two dice, each of a different color and different size versus another two dice, each of a different color and different size. Game apparatus includes a layout (40) providing twelve betting areas (A-L) and chips (50) for placing wagers on twelve possible bets.

U.S. Pat. No. 5,413,351 (Franklin) describes a dice game involving wagering on the outcome of a toss of three dies. A player places a first bet means. If the dealer throws a preselected winning combination, such as a 4-5-6, triple, or pair and a 6, the dealer wins. If the dealer throws a preselected losing combination, such as a 1-2-3 or a pair and a one, the dealer loses. If the dealer throws a third combination, such as a pair and a 2-3-4 or 5, then the player throws in an attempt to beat the dealer. If the player throws a preselected combination, such as a 4-5-6, or a pair and single die having a value higher than that of the dealer, the player wins. If the player throws a preselected loser, such as a 1-2-3, or a pair and single die having a value less than that of the dealer, the player loses.

If the player or dealer does not throw one of above stated winning or losing combinations, then the dealer or player must throw again. Each player may place a second bet that the outcome of the game will result in predetermined winning die combination yielding a predetermined winning payout. A player may also place bonus bet means, wherein if that particular throw results in a preselected combination, such as triple sixes, the player is entitled to a throw. If the player throws another preselected combination, such as a triple six, the player is entitled to a large winning payout.

U.S. Pat. No. 5,505,457 (Boylan) describes a method of playing a wagering game simulating the sport of bowling where an outcome is determined by a random value symbol generator actuatable by a player. The method of play simulates the game of bowling. First and second predetermined range of values are selected by a house, and a round of the game is played by the player beginning with the wagering of a wager that a first generation of the value symbol will be within the first predetermined range of values or that a second generation of the value symbol when added to the first generated value symbol will be within the second predetermined range of values. The player then activates the random value symbol generator to produce a first value symbol, and then activates the random value symbol generator to produce a second value symbol where the first value symbol is not within the first predetermined range of values. Where the second value symbol is generated, the value of the first value symbol and the second value symbol are added together to generate a sum. Finally, settling of the wager occurs. Preferably, the wagering game further includes continuing a turn of the player by playing another round where the first value symbol is within the first range or the sum of the first and second value symbols is within the second range and the wagering that the player will play a predetermined number of consecutive rounds and/or will generate a first value symbol in the first range for a predetermined number of consecutive rounds.

U.S. Pat. No. 5,620,183 (Skratulia) describes a game in which a set of dice (20, 120) produces a range of numerical values including a plurality of diced each having a representation of a selected number disposed on each of its six sides. In one embodiment the set of dice 20 includes first die 22, second die 24, and third die 26, and the range of numerical values produced is one through eight. In a second embodiment the set of dice 120 includes first die 122 and second die 124, and the range of numerical values produced is one through nine. A method for randomly generating one of the numbers one through eight or one through nine, with each number one through eight having an equal 0.125 probability of being generated, comprising the steps of: providing first, second, and third six-sided dice, said first die having a representation of the number zero disposed on three sides and a representation of the number two disposed on three sides; said second die having a representation of the number one disposed on three sides and a representation of the number two disposed on three sides; and, said third die having a representation of the number zero disposed on three sides and a representation of the number four disposed on three sides; rolling said first, second, and third six-sided dice, after rolling said first, second, and third six-sided dice, each die having an uppermost side; and, numerically totaling said uppermost sides of said first, second, and third six-sided dice.

U.S. Pat. No. 6,893,019 (Gaygen teaches a casino-type table betting game using one die of one color, or otherwise singularly marked, and two matching dice of another color, or otherwise marked as a pair. Players make wagers on the outcome of a single roll of the three dice. Wagers are made by placing bet markers on various areas of a game board that define bet types. One group of wagers is on the outcome of the singular die. A second group of wagers is on the pair of dice. A third group of wagers is on the total of all three dice. When the outcome of the singular die is a predetermined number (e.g., 1), the house wins all bets on the game board regardless of the outcome of the other two dice. A method of playing a dice game has a dealer, who is an agent or employee of a game operator or house, and a plurality of players comprises the steps of: a) providing one of said players with two dice of one color, or otherwise identified as a pair, and one die of another color, or otherwise identified as a singleton, or electronic or other representations thereof, said dice being hexahedral and each side of each die marked with a different indicia representing a number from one to six inclusive; b) providing a game surface, or electronic or other representation thereof, having a betting area where said players make bets by placing a betting marker or markers, said betting area having one section for placing bets on the outcome of said single die including only outcomes 2, 3, 4, 5, and 6, one section for placing bets on the outcome of said pair of dice including outcomes 2, 3, 4, 5, 6, 7, 8, 9, 10, 11, and 12, one section for placing bets on the total of all three said dice including only outcomes 4, 5, 6, 7, 8, 9, 10, 11, 12, 13, 14, 15, 16, 17, and 18, one section for ancillary bets related to the outcome of said single die, one section for ancillary bets related to the outcome of said pair of dice, one section for ancillary bets related to the outcome of all three said dice, said game surface having no section for placing bets on said single die having an outcome of 1, wherein the dice game does not allow for the placing of bets on the single die outcome of 1; c) providing payout odds for a winning bet for each bet on the game surface; d) said players placing bets on said game surface; e) said shooter rolling all three said dice together completing one play of said game; f) said dealer determining winning bets by determining which bets match the outcome of the roll of the dice when the outcome of said single die is 2, 3, 4, 5, or 6; g) said dealer taking possession of said betting markers on losing bets and paying said players making winning bets according to payout odds; h) said dealer taking possession of any and all said betting markers anywhere on said game surface when the outcome of said single die is 1.

Various three-dice board games and wagering games also include U.S. Pat. No. 5,791,651 (Bryant); U.S. Pat. No. 5,879,006 (Bowling); and U.S. Pat. No. 6,378,869 (Hedge et al.). In spite of the options available for dice games, the only game that has established a following at casinos is traditional craps games. It is believed that a novel game with simplicity of play and ancillary topical interest can be a novel game that attracts new players and can maintain interest.

SUMMARY OF THE INVENTION

A gaming system and gaming play use three dice (physical dice or virtual dice) to provide random events. The random events are related to physical or distance movements or points scored on a field or track or map. The dice are provided as two dice representing a portion of the random event determinant and the third die acting as a separate portion of the event determinant, such as a selector for a particular column in an event result table. The first two dice are differentiated from the third die by obvious physical and visually observable characteristics, such as size and/or color. At least one wager is placed on the game by at least one player, and the dice are cast to provide the random outcome. The wager may be a running event wager or a proposition bet. The total of the two dice in combination with the particular symbol provided by the third die determine event results such as a single roll win, a single roll loss or an advancement of a gaming object in a continuing step in the game. An array of different wagers may be offered to players for both continuing wagers and proposition bets. The format of the game table and play surface can be designed to offer a theme in which the wagers and the random dice outcomes can be related to the theme. For example, in using an American Football theme, winning and losing events can be provided by dice roll outcomes equated to touchdowns, interceptions, extra-points, penalties, first downs and the like.

BRIEF DESCRIPTION OF THE FIGURES

FIG. 3 (Exhibit B) shows a result table or event table or the rolls of the dice.

DETAILED DESCRIPTION OF THE INVENTION

Figure 1:
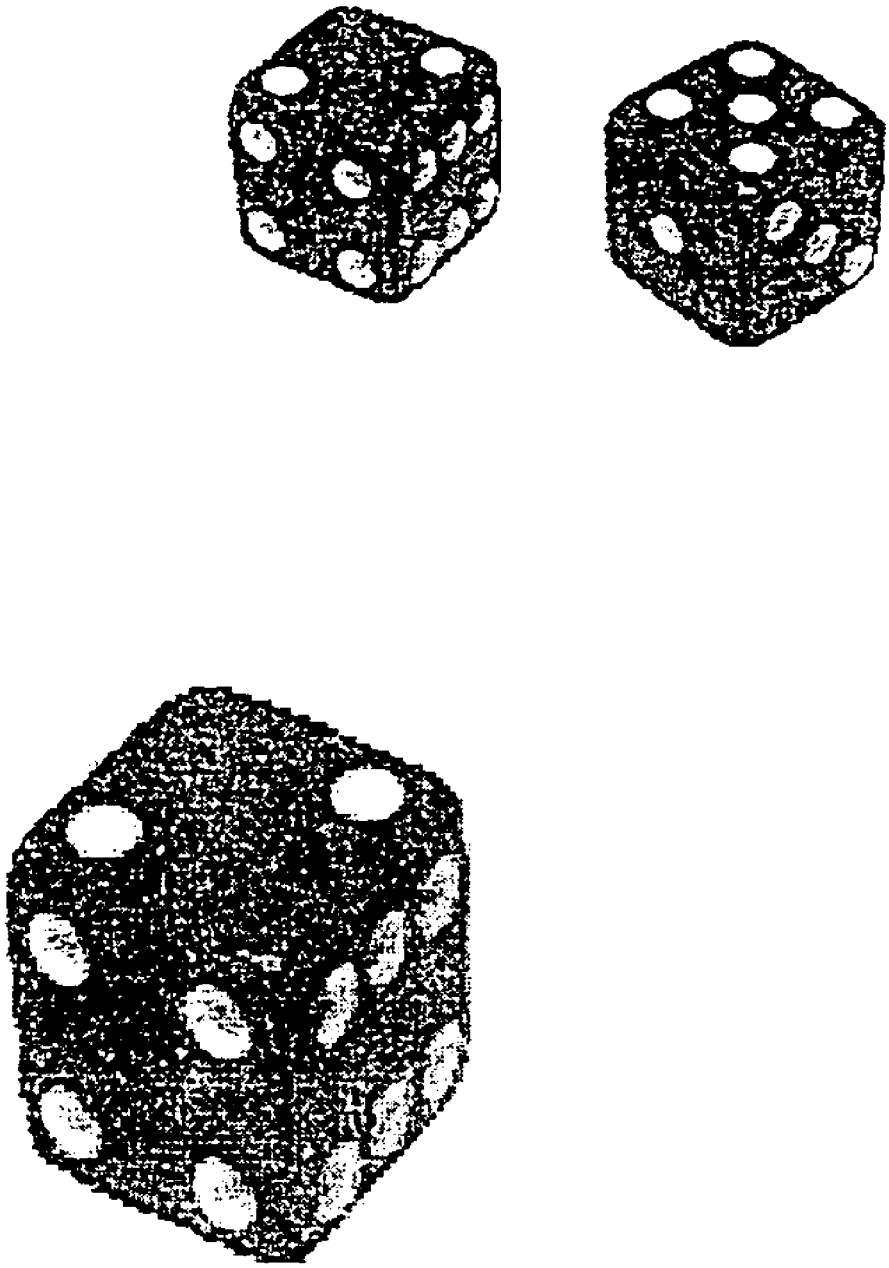
FIG. 1 shows three dice that may be used in the practice of the technology described herein.
Figure 2:
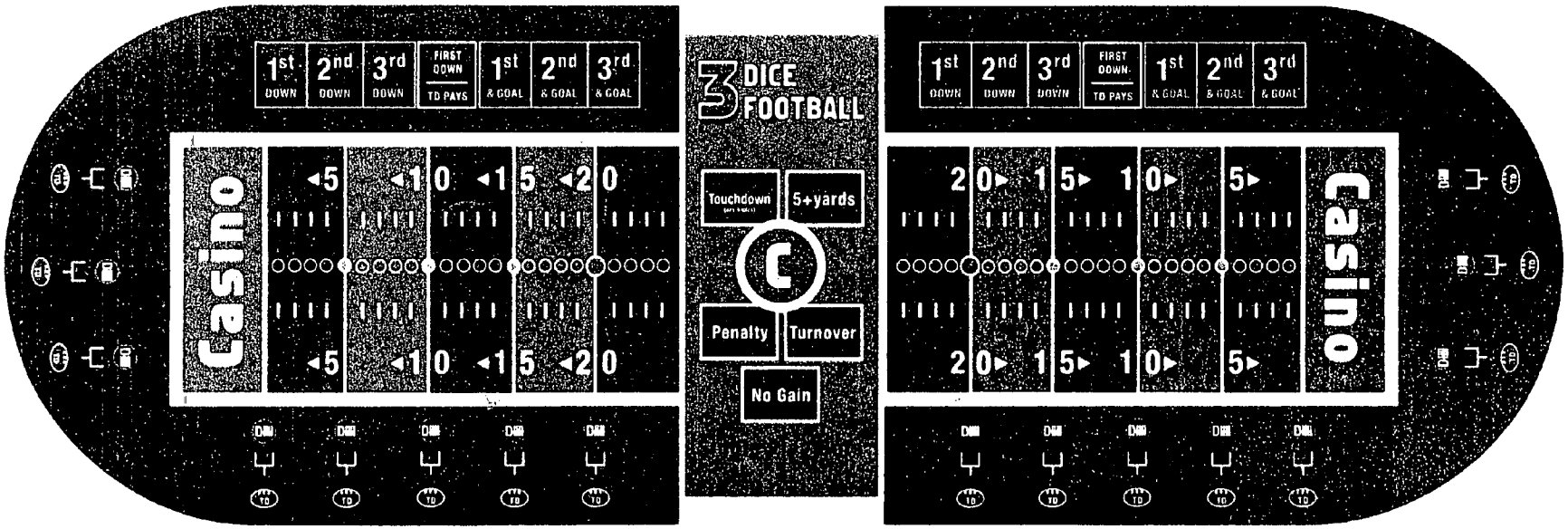
FIG. 2 (Exhibit A) shows a game table layout using part of an American Football layout to represent results of dice rolls in the play of the game described herein.
Figure 4:
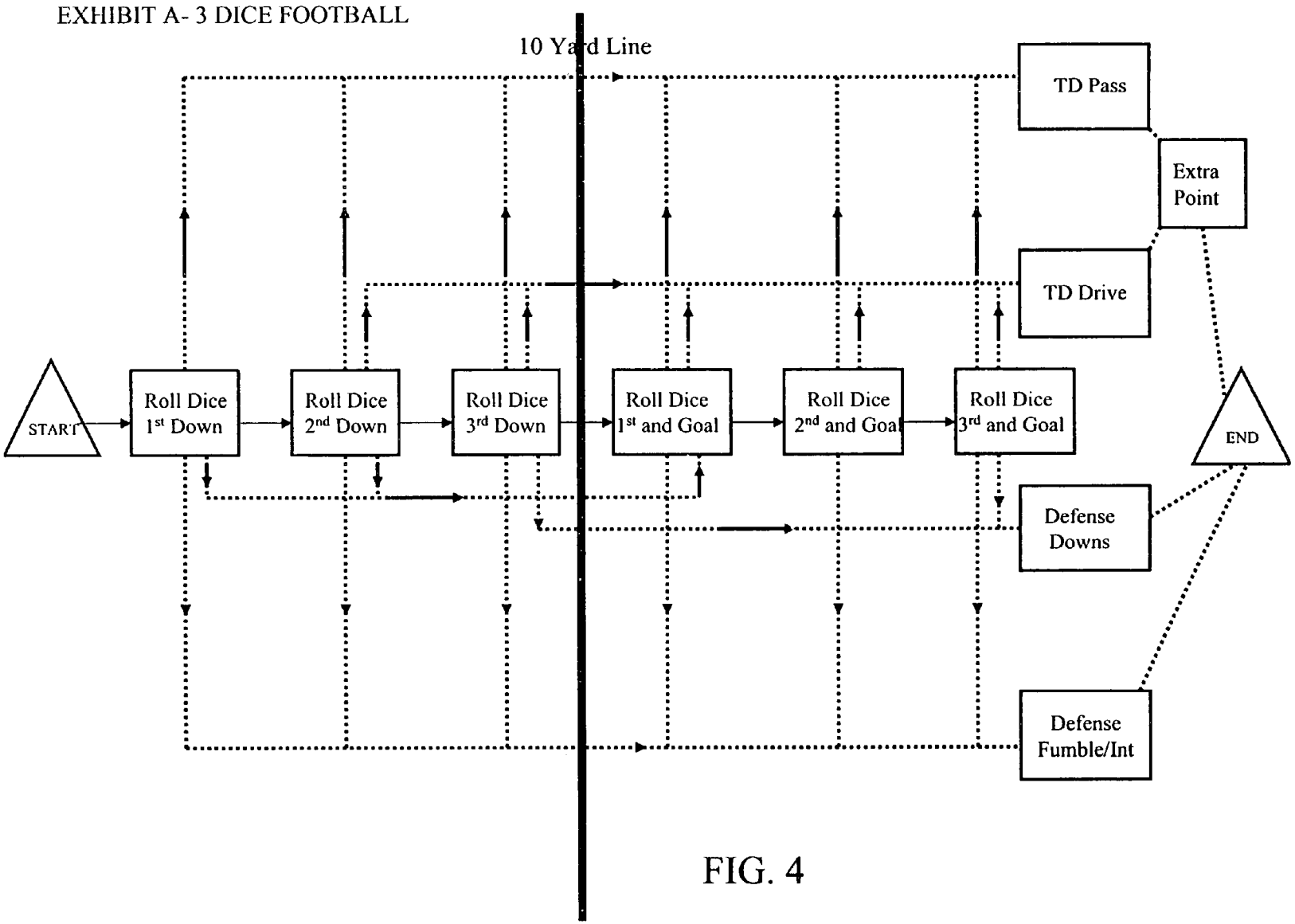
FIG. 4 shows a flowchart of game play.

A board game, casino table wagering game, video game, internet game or internet wagering game simulates events in an American Football game or other field game (e.g., soccer, baseball, cricket, field hockey, ice hockey, lacrosse, horse racing, dog racing, track-and-field and the like) by providing a gaming field (or virtual gaming field) on which a game piece, marker, virtual game piece or virtual marker is moved as the result of random numerical events determined by three dice. As in craps, a series of rolls or possessions can be played while attempting to achieve an ultimate event (e.g., touchdown, run, goal, first down, etc.) while the player(s) of the game make wagers as to the outcome of the total game activity (a touchdown or loss of possession) or the events of single rolls (proposition wagers and winning/losing outcomes, first downs, interceptions, fumbles, etc.). Although there are many variations in the nomenclature of events because of the use of different sports themes in the play of the game, there is a unifying feature with regard to the equipment, probabilities, events, payout odds, house hold and other elements of the game. The fact that the game can be provided in many different formats with the same or similar underlying features in the game play should be remembered, even though the description of the game will emphasize American football terminology, and these descriptions are not intended to limit the game to that single theme. Instead, the use of American football terminology is intended to be a description of a species of play within the generic concepts of the broad invention.

A field is present as a design on a table or a virtual image on a screen and three dice are used as the random event generator. The dice preferably are standard appearance die, with six faces and numbering symbols of 1, 2, 3, 4, 5 and 6 on the faces of the dice. At a minimum, the two similar dice should be standard dice with one of six different number indicators on each of the six faces of the die. The third die may be physically observably distinct from the first two dice, and may also have standard numbering on its facing, but may also have other symbology (e.g., A, B, C, D, E and F; six different team logos; etc.) on their faces, as the symbols or numbers on the third die are not necessarily used to form a total number for use in the game, but rather tends to be used to select an event result table during the play of the game. This fact will be explained in greater detail later.

Standard dice have opposed faces that total a number 7, but this is not essential in the practice of the invention. The dice are designed with two dice being essentially within a single grouping (e.g., the same size, the same color or combinations thereof) and one die in a distinct grouping (e.g., a different size, a different color or combinations thereof, different symbology on the faces, and combinations of these).

The game described herein will be referred to as "3 Dice Football"™ and is a fast paced and exciting table game, which uses 3 dice to play the game. 3 Dice Football™ is intended as a gambling game for use in Casinos, but may be used on the internet, on video wagering apparatus, as a video game or a board game.

Game Objective and Rules: (See Exhibit A)

The primary apparent objective of the game is to place a wager and score a Touchdown, although wagers may be placed on various events, including not scoring a touchdown. The Three-Dice Football™ game begins with a game piece or position indicator being placed at a start location on the field. For example, the "football" being moved by events in the play of the game (e.g., which may be represented on the game table by a small football helmet) placed on the offensive twenty (20) yard line. The roller of the dice (known as the 'quarterback') begins by rolling three (3) dice (e.g., two (2) six-sided green dice and one (1) six-sided red die). The dice determine the outcome of the play (see the table of FIG. 3 in Exhibit B). In the ordinary play of the game, the quarterback has three (3) plays (three rolls of the three dice) to reach the ten (10) yard line (known as achieving a '1$^{st}$ down'). There is only one (1) 1$^{st}$ down possible per game. If a 1$^{st}$ down is achieved, the quarterback then has three (3) additional plays to score a Touchdown. A Penalty can occur on any play as shown by PEN in the table of FIG. 3 (Exhibit B). A penalty results in a loss of the current down and a loss of one (1) yard. An 'Instant Touchdown,' or 'Turnover' can occur on any play, as also shown in the table of FIG. 3 (Exhibit B). Whenever a Touchdown is scored, the quarterback rolls the dice one (1) time (known as 'extra-point') and there is a separate potential for extra-point payouts. After the extra-point roll, that round of the game ends. If a Touchdown is not scored in the designated number of plays, or if a Turnover is rolled, that round of the game ends, just as if a shooter has crapped out in Craps.

Different Bets:

All players at the table may bet on any or all of the following proposition bets, and all final payouts are to be determined by the Casino. The payouts listed below are suggestions only and are not intended to limit the scope of the game or the scope of payouts available.

Touchdown: This bet must be made at the beginning of the game. This bet wins if a touchdown is scored. The payout is 1:1.

Extra-Point: This bet must be made at the beginning of the game. If a touchdown is scored, one (1) roll is made with three (3) dice. The payout is as follows: If one (1) of the dice contains the number one, the payout is 1 for 1; if two (2) of the dice contain the number one, the payout is 10 for 1; if all three (3) dice contain the number one (or the two similar dice are "one" (1) and a specific single symbol appears on the third die (e.g., a Super Bowl™ game symbol), the payout may be approximately 175 for 1.

Defense: This bet must be made at the beginning of the game. This bet wins if a touchdown is not scored, or a turnover is rolled. The payout is to be determined (TBD).

First Down: This bet must be made at the beginning of the game. This bet wins if a first down is achieved or a touchdown is scored. The payout is TBD.

No First Down: This bet must be made at the beginning of the game. This bet wins if both a first down is not achieved and a touchdown is not scored. The payout is TBD.

Touchdown on Down 'X': This bet must be made at the beginning of the game. This bet wins if a touchdown is scored on the correct down. The payouts vary by down and are TBD.

Touchdown (1 Play): This bet can be made at the beginning of any play. This bet wins if an 'instant touchdown' is scored (see Exhibit B). A touchdown scored by yards gained does not qualify for this bet. The payout is 30:1.

Turnover (1 Play): This bet can be made at the beginning of any play. This bet wins if a turnover occurs (see Exhibit B). A turnover by downs does not qualify for this bet. The payout is 60:1.

Penalty (1 play): This bet can be made at the beginning of any play. This bet wins if a penalty occurs (see Exhibit B). The payout is 9:1.

No Gain (1 play): This bet can be made at the beginning of any play. This bet wins if zero (0) yards are gained, or if a penalty occurs, or if a turnover occurs. The payout is 5:1.

5 yards+(1 play): This bet can be made at the beginning of any play in which the football is marked on the five (5) yard line or beyond. This bet wins if five (5) or more yards are gained, or if an 'instant touchdown' is scored. The payout is 9:8.

Possible Design Ideas:

The outside and top of the game table can resemble a football stadium.

The three dice can be placed in a small devise that resembles a football; the 'quarterback' would then roll this devise down the table.

The object that marks what yard line the football is on can be a small football helmet. The quarterback can choose from 2 different colored helmets (home/away) before each game. The helmet can contain the casino logo on the side of the helmet.

The table can contain digital displays to provide game information similar to a digital scoreboard at a football stadium. The digital displays can also be used for marketing purposes.

The side panels on the inside of the game table can be used as advertising space for sponsors.

The marker that indicates what down it is can be a small object in the shape of a football with a logo of the casino on it.

The field can represent any sports or wagering playing field by merely altering the art work. The changes are obvious in simply shifting from American Football to soccer, field hockey or even basketball and ice hockey. The changes to such events as a horse race (e.g., complaint changed for penalty; passing field at a turn changed for first down; stumbling for penalty; falling for interception; etc.) are more subtle, but equally effective in maintaining the ambiance of the sporting event and yet retaining the identical or at least similar event outcomes with the rolls of the dice (according to Exhibit B).

The Table of Exhibit B provides event outcomes determined by;

| G | G | R | RES |
|---|---|---|---|
| 1 | 1 | 1 | TD |
| 1 | 2 | 1 | 2 |
| 1 | 3 | 1 | 3 |
| 1 | 4 | 1 | 4 |
| 1 | 5 | 1 | 5 |
| 1 | 6 | 1 | 6 |
| 2 | 1 | 1 | 2 |
| 2 | 2 | 1 | 3 |
| 2 | 3 | 1 | 4 |
| 2 | 4 | 1 | 5 |
| 2 | 5 | 1 | 6 |
| 2 | 6 | 1 | 7 |
| 3 | 1 | 1 | 3 |
| 3 | 2 | 1 | 4 |
| 3 | 3 | 1 | 5 |
| 3 | 4 | 1 | 6 |
| 3 | 5 | 1 | 7 |
| 3 | 6 | 1 | 8 |

| G | G | R | RES |
|---|---|---|---|
| 1 | 1 | 2 | TO |
| 1 | 2 | 2 | 1 |
| 1 | 3 | 2 | 2 |
| 1 | 4 | 2 | 3 |
| 1 | 5 | 2 | 4 |
| 1 | 6 | 2 | 5 |
| 2 | 1 | 2 | 1 |
| 2 | 2 | 2 | TD |
| 2 | 3 | 2 | 3 |
| 2 | 4 | 2 | 4 |
| 2 | 5 | 2 | 5 |
| 2 | 6 | 2 | 6 |
| 3 | 1 | 2 | 2 |
| 3 | 2 | 2 | 3 |
| 3 | 3 | 2 | 4 |
| 3 | 4 | 2 | 5 |
| 3 | 5 | 2 | 6 |
| 3 | 6 | 2 | 7 |

| G | G | R | RES |
|---|---|---|---|
| 1 | 1 | 3 | PEN |
| 1 | 2 | 3 | 0 |
| 1 | 3 | 3 | 1 |
| 1 | 4 | 3 | 2 |
| 1 | 5 | 3 | 3 |
| 1 | 6 | 3 | 4 |
| 2 | 1 | 3 | 0 |
| 2 | 2 | 3 | 1 |
| 2 | 3 | 3 | 2 |
| 2 | 4 | 3 | 3 |
| 2 | 5 | 3 | 4 |
| 2 | 6 | 3 | 5 |
| 3 | 1 | 3 | 1 |
| 3 | 2 | 3 | 2 |
| 3 | 3 | 3 | TD |
| 3 | 4 | 3 | 4 |
| 3 | 5 | 3 | 5 |
| 3 | 6 | 3 | 6 |

| G | G | R | RES |
|---|---|---|---|
| 1 | 1 | 4 | PEN |
| 1 | 2 | 4 | PEN |
| 1 | 3 | 4 | 0 |
| 1 | 4 | 4 | 1 |
| 1 | 5 | 4 | 2 |
| 1 | 6 | 4 | 3 |
| 2 | 1 | 4 | PEN |
| 2 | 2 | 4 | TO |
| 2 | 3 | 4 | 1 |
| 2 | 4 | 4 | 2 |
| 2 | 5 | 4 | 3 |
| 2 | 6 | 4 | 4 |
| 3 | 1 | 4 | 0 |
| 3 | 2 | 4 | 1 |
| 3 | 3 | 4 | 2 |
| 3 | 4 | 4 | 3 |
| 3 | 5 | 4 | 4 |
| 3 | 6 | 4 | 5 |

| G | G | R | RES |
|---|---|---|---|
| 1 | 1 | 5 | PEN |
| 1 | 2 | 5 | PEN |
| 1 | 3 | 5 | PEN |
| 1 | 4 | 5 | 0 |
| 1 | 5 | 5 | 1 |
| 1 | 6 | 5 | 2 |
| 2 | 1 | 5 | PEN |
| 2 | 2 | 5 | PEN |
| 2 | 3 | 5 | 0 |
| 2 | 4 | 5 | 1 |
| 2 | 5 | 5 | 2 |
| 2 | 6 | 5 | 3 |
| 3 | 1 | 5 | PEN |
| 3 | 2 | 5 | 0 |
| 3 | 3 | 5 | 1 |
| 3 | 4 | 5 | 2 |
| 3 | 5 | 5 | 3 |
| 3 | 6 | 5 | 4 |

| G | G | R | RES |
|---|---|---|---|
| 1 | 1 | 6 | PEN |
| 1 | 2 | 6 | PEN |
| 1 | 3 | 6 | PEN |
| 1 | 4 | 6 | PEN |
| 1 | 5 | 6 | 0 |
| 1 | 6 | 6 | 1 |
| 2 | 1 | 6 | PEN |
| 2 | 2 | 6 | PEN |
| 2 | 3 | 6 | PEN |
| 2 | 4 | 6 | 0 |
| 2 | 5 | 6 | 1 |
| 2 | 6 | 6 | 2 |
| 3 | 1 | 6 | PEN |
| 3 | 2 | 6 | PEN |
| 3 | 3 | 6 | TO |
| 3 | 4 | 6 | 1 |
| 3 | 5 | 6 | 2 |
| 3 | 6 | 6 | 3 |

-continued

| | | | |
|---|---|---|---|
| 4 | 1 | 1 | 4 |
| 4 | 2 | 1 | 5 |
| 4 | 3 | 1 | 6 |
| 4 | 4 | 1 | 7 |
| 4 | 5 | 1 | 8 |
| 4 | 6 | 1 | 9 |

| | | | |
|---|---|---|---|
| 4 | 1 | 2 | 3 |
| 4 | 2 | 2 | 4 |
| 4 | 3 | 2 | 5 |
| 4 | 4 | 2 | 6 |
| 4 | 5 | 2 | 7 |
| 4 | 6 | 2 | 8 |

| | | | |
|---|---|---|---|
| 4 | 1 | 3 | 2 |
| 4 | 2 | 3 | 3 |
| 4 | 3 | 3 | 4 |
| 4 | 4 | 3 | 5 |
| 4 | 5 | 3 | 6 |
| 4 | 6 | 3 | 7 |

| | | | |
|---|---|---|---|
| 4 | 1 | 4 | 1 |
| 4 | 2 | 4 | 2 |
| 4 | 3 | 4 | 3 |
| 4 | 4 | 4 | TD |
| 4 | 5 | 4 | 5 |
| 4 | 6 | 4 | 6 |

| | | | |
|---|---|---|---|
| 4 | 1 | 5 | 0 |
| 4 | 2 | 5 | 1 |
| 4 | 3 | 5 | 2 |
| 4 | 4 | 5 | 3 |
| 4 | 5 | 5 | 4 |
| 4 | 6 | 5 | 5 |

| | | | |
|---|---|---|---|
| 4 | 1 | 6 | PEN |
| 4 | 2 | 6 | 0 |
| 4 | 3 | 6 | 1 |
| 4 | 4 | 6 | 2 |
| 4 | 5 | 6 | 3 |
| 4 | 6 | 6 | 4 |

| | | | |
|---|---|---|---|
| 5 | 1 | 1 | 5 |
| 5 | 2 | 1 | 6 |
| 5 | 3 | 1 | 7 |
| 5 | 4 | 1 | 8 |
| 5 | 5 | 1 | 9 |
| 5 | 6 | 1 | 10 |

| | | | |
|---|---|---|---|
| 5 | 1 | 2 | 4 |
| 5 | 2 | 2 | 5 |
| 5 | 3 | 2 | 6 |
| 5 | 4 | 2 | 7 |
| 5 | 5 | 2 | 8 |
| 5 | 6 | 2 | 9 |

| | | | |
|---|---|---|---|
| 5 | 1 | 3 | 3 |
| 5 | 2 | 3 | 4 |
| 5 | 3 | 3 | 5 |
| 5 | 4 | 3 | 6 |
| 5 | 5 | 3 | 7 |
| 5 | 6 | 3 | 8 |

| | | | |
|---|---|---|---|
| 5 | 1 | 4 | 2 |
| 5 | 2 | 4 | 3 |
| 5 | 3 | 4 | 4 |
| 5 | 4 | 4 | 5 |
| 5 | 5 | 4 | 6 |
| 5 | 6 | 4 | 7 |

| | | | |
|---|---|---|---|
| 5 | 1 | 5 | 1 |
| 5 | 2 | 5 | 2 |
| 5 | 3 | 5 | 3 |
| 5 | 4 | 5 | 4 |
| 5 | 5 | 5 | TD |
| 5 | 6 | 5 | 6 |

| | | | |
|---|---|---|---|
| 5 | 1 | 6 | 0 |
| 5 | 2 | 6 | 1 |
| 5 | 3 | 6 | 2 |
| 5 | 4 | 6 | 3 |
| 5 | 5 | 6 | 4 |
| 5 | 6 | 6 | 5 |

| | | | |
|---|---|---|---|
| 6 | 1 | 1 | 6 |
| 6 | 2 | 1 | 7 |
| 6 | 3 | 1 | 8 |
| 6 | 4 | 1 | 9 |
| 6 | 5 | 1 | 10 |
| 6 | 6 | 1 | 11 |

| | | | |
|---|---|---|---|
| 6 | 1 | 2 | 5 |
| 6 | 2 | 2 | 6 |
| 6 | 3 | 2 | 7 |
| 6 | 4 | 2 | 8 |
| 6 | 5 | 2 | 9 |
| 6 | 6 | 2 | 10 |

| | | | |
|---|---|---|---|
| 6 | 1 | 3 | 4 |
| 6 | 2 | 3 | 5 |
| 6 | 3 | 3 | 6 |
| 6 | 4 | 3 | 7 |
| 6 | 5 | 3 | 8 |
| 6 | 6 | 3 | 9 |

| | | | |
|---|---|---|---|
| 6 | 1 | 4 | 3 |
| 6 | 2 | 4 | 4 |
| 6 | 3 | 4 | 5 |
| 6 | 4 | 4 | 6 |
| 6 | 5 | 4 | 7 |
| 6 | 6 | 4 | 8 |

| | | | |
|---|---|---|---|
| 6 | 1 | 5 | 2 |
| 6 | 2 | 5 | 3 |
| 6 | 3 | 5 | 4 |
| 6 | 4 | 5 | 5 |
| 6 | 5 | 5 | 6 |
| 6 | 6 | 5 | 7 |

| | | | |
|---|---|---|---|
| 6 | 1 | 6 | 1 |
| 6 | 2 | 6 | 2 |
| 6 | 3 | 6 | 3 |
| 6 | 4 | 6 | 4 |
| 6 | 5 | 6 | 5 |
| 6 | 6 | 6 | TD |

wherein RES is a result, TD is a touchdown, TO is a turnover, PEN is a penalty and G is a value on a die.

Other Variations:

A 'kickoff' roll of the dice can be used to determine starting field position at the beginning of the game.

The Extra-Point bet can be a 'bonus' type bet with a dollar limit set.

An additional bet is whether an instant touchdown, turnover, or penalty will occur during the game.

An additional bet is how many plays the game will last.

An additional bet is how many yards an individual play will result in.

The general game may be described as follows. A wagering game comprises the steps of:

a) a player placing at least one wager to play in the wagering game;

b) a player, the house or a mechanical device casting three dice to generate a random event. The three dice consist of two dice whose exposed numbers are used to define a numeric result, and the third die is used to characterize that numeric result in event result tables or paytables;

c) the random event of the casting of the three dice is compared with event result tables (e.g., see Exhibit B) and then with the paytables to determine wagering or game events from the random event; and d) wins or losses based upon the random event are resolved; moving a game piece in a continuing of the wagering game; or both resolving wins or losses based upon the random event and moving a game piece in a continuing of the wagering game. The wagering game may have the two dice with six faces, wherein each face has a number indicator of only one of 1, 2, 3, 4, 5 or six thereon, and each of the six faces has a different number indicator thereon, as is typical with a standard Craps die. The third die has a visual appearance distinguishing the third die from the two dice, as with a different color, a different size, different symbology on the faces (e.g., numbers 1, 2, 3, 4, 5 and 6, rather than the appropriate numbers of spots; different team symbols; different player symbols;.different astrological symbols; or any other visually distinguishable markings or coloration of the die and its faces. In the game, a physical or virtual surface is used to move a game piece an amount related to the numeric total of the two dice and an event result table and/or a paytable is associated to the numeric result by a random outcome on the third die according to rules of play of the game. The wagering game preferably provides a surface that has markings and words relating the wagering game to a sporting event, such as for American Football. In the wagering game, the event outcome or event result table is separate from a paytable and the event outcome or event result table (Exhibit B) identifies at least touchdowns, distance of ball movement and penalties according to the combination of numerical result from the two dice and the specific results associated with displayed symbology on the third die. In the wagering game, after a touchdown occurs in the wagering game, at least one die may recast to determine if an extra point wagering event is achieved. The wagering game allows that proposition wagers may be placed on at least one proposition wager event determined by the casting of the three dice selected from the group consisting of a) a one-roll touchdown; b) a one-roll first down (preferably there is no instant one roll first down— a first down ordinarily can only be achieved by moving the football at least ten yards; even though some rolls are 10 yards or more outcome it is not an automatic first down— on each roll a player needs a different number of yards to get a first down); c) a one roll penalty; a one roll specific yardage result; and a one-roll turnover (interception or fumble).

The technology may be practiced, for example, as a virtual electronic system or preferably as a gaming system for playing the wagering game described above comprising:

a gaming table having an upper surface with indicia thereon indicating distances and positions for moving the game piece;

the game piece for placement on the upper surface; and three dice, the three dice comprising two dice for defining the numeric result and a third die that is visually distinguishable from the two dice for characterizing that numeric result in event result tables or paytables. The gaming system may have the indicia represent field position on an American Football playing field and betting areas are provided for placing wagers on at least one of touchdowns, first downs, penalties, no touchdowns, and no first downs. The odds for specific outcomes are printed on the upper surface.

What is claimed:

1. A method of playing a wagering game comprising the steps of:

providing three dice, a first two of the three dice having a plurality of faces and each face having a number indicator, the third die having a plurality of faces and each face having a number indicator, the third die having a visual appearance that is distinct from the visual appearance of the first two dice;

providing an event result tables or paytables having a plurality of outcomes arranged in rows and columns;

a player placing at least one wager to play in the wagering game;

casting the three dice to generate a random event, the three dice consisting of two dice whose exposed numbers are used to define a numeric result corresponding to a particular row of the tables or paytables, and the third die used to define a number corresponding to a column of the table or paytable to determine an outcome of that numeric result from the first two dice in event result tables or paytables;

comparing the random event of the casting of the three dice with the event result tables or paytables to determine wagering or game events from the random event; and resolving wins or losses based upon the random event; moving a game piece in a continuing of the wagering game; or both resolving wins or losses based upon the random event and moving a game piece in a continuing of the wagering game.

2. The method of claim 1 wherein the two dice have six faces and each face has a number indicator of only one of 1, 2, 3, 4, 5 or six thereon, and each of the six faces has a different number indicator thereon.

3. The method of claim 1 wherein the third die has six faces and each face has a number indicator of only one of 1, 2, 3, 4, 5 or six thereon, and each of the six faces has a different number indicator thereon.

4. The method of claim 1 wherein a surface is used to move a game piece an amount related to the numeric total of the two dice and a paytable associated to the numeric result by a random outcome on the third die according to rules of play of the game.

5. The method of claim 4 wherein the surface has markings and words relating the wagering game to a sporting event.

6. The method of claim 5 wherein the sporting event is American Football.

7. The method of claim 6 wherein the event outcome table is separate from a paytable and identifies at least touchdowns, distance of ball movement and penalties according to the combination of numerical result from the two dice and the specific results associated with displayed symbology on the third die.

8. The method of claim 7 wherein after a touchdown occurs in the wagering game, at least one die is recast to determine if an extra point wagering event is achieved.

9. The method of claim 7 wherein proposition wagers may be placed on at least one proposition wager event determined by the casting of the three dice selected from the group consisting of a) a one-roll touchdown; b) a one-roll turnover; c) a one roll penalty; and d) a one roll specific yardage result.

10. The method of claim 7 wherein the event outcome is determined by the table.

11. The method of claim 10 wherein proposition wagers may be placed on at least one proposition wager event determined by the casting of the three dice selected from the group consisting of a) a one-roll touchdown; b) a one-roll turnover; c) a one roll penalty; and d) a one roll specific yardage result.

12. A gaming system for playing the wagering game of claim 1 comprising:

a gaming table having an upper surface with indicia thereon indicating distances and positions for moving the game piece;

the game piece for placement on the upper surface;

an event result tables or paytables having a plurality of outcomes arranged in rows and columns; and three dice, the three dice comprising two dice for defining the numeric result corresponding to a particular row of the tables or paytables, and a third die that is visually distinguishable from the two dice for providing a visual appearance that is distinct from the visual appearance of the first two dice, and the third die used to define a number corresponding to a column of the table or paytable to determine an outcome of that numeric result from the first two dice in event result tables or paytables.

13. The gaming system of claim 12 wherein the indicia represent field position on an American Football playing field and betting areas are provided for placing wagers on at least one of touchdowns, first downs, penalties, turnovers, no touchdowns, and no first downs.

14. The gaming system of claim 13 wherein odds for specific outcomes are printed on the upper surface.

* * * * *